US007753829B1

(12) United States Patent
Schaller et al.

(10) Patent No.: US 7,753,829 B1
(45) Date of Patent: Jul. 13, 2010

(54) TRAINING DEVICE

(76) Inventors: Bret Schaller, 1806 Carthage St., Sanford, NC (US) 27330; Diane K Schaller, 1806 Carthage St., Sanford, NC (US) 27330

( * ) Notice: Subject to any disclaimer, the term of this patent is extended or adjusted under 35 U.S.C. 154(b) by 0 days.

(21) Appl. No.: 11/678,090

(22) Filed: Feb. 23, 2007

(51) Int. Cl.
*A63B 21/00* (2006.01)
*A63B 71/00* (2006.01)

(52) U.S. Cl. ..... 482/132; 482/145

(58) Field of Classification Search ..... 482/23, 482/132, 49, 139, 131, 145, 146, 25, 66, 482/68; 472/14–16, 135; 273/440–441, 273/449; 446/431, 450, 452; 280/200, 206, 280/207; 105/142
See application file for complete search history.

(56) References Cited

U.S. PATENT DOCUMENTS 3,006,645 A * 10/1961 Frazier ..... 482/43
3,767,191 A * 10/1973 Riley ..... 482/25
3,784,192 A * 1/1974 Nutter ..... 482/132
3,857,563 A 12/1974 Azara ..... 272/58
3,895,795 A * 7/1975 Merz ..... 482/8
4,126,308 A * 11/1978 Crumley ..... 482/25
4,339,126 A * 7/1982 Marletta ..... 482/132
4,595,197 A * 6/1986 Hagstrom et al. ..... 482/132
4,961,574 A * 10/1990 Lew ..... 472/17
5,221,241 A * 6/1993 Bare, II ..... 482/43
5,551,950 A * 9/1996 Oppen ..... 601/35
6,238,325 B1 * 5/2001 Oxford ..... 482/146
6,533,635 B1 * 3/2003 Chern ..... 446/236
7,232,357 B2 * 6/2007 Chen ..... 446/236
2006/0217242 A1 * 9/2006 Karpachev ..... 482/77

* cited by examiner

*Primary Examiner*—Loan H Thanh
*Assistant Examiner*—Sundhara M Ganesan
(74) *Attorney, Agent, or Firm*—MacCord Mason PLLC

(57) ABSTRACT

A training device is shown and described. The device comprises a disk having a perimeter. A foot-interface is attached to the disk. A rolling member is positioned around the perimeter of the disk and is preferably substantially concentric with the disk.

20 Claims, 12 Drawing Sheets

TRAINING DEVICE

BACKGROUND (1) Field

The present invention relates generally to training devices for improved fitness, and more particularly, to training devices designed to strengthen certain muscles of the body. Even more particularly, the present invention relates to a training device for developing the strength and coordination beneficial when performing certain gymnastic movements.

(2) Related Technology

The pommel horse is well known in the art. It has a cylindrical body covered with leather and two upright handles, or pommels, near the center. The pommel horse is usually held off the ground by a support at each end.

Performing exercises on the pommel horse is difficult and requires significant strength. These exercises involve placing the hands on either the horse or the pommels and swinging the legs in a circular motion while holding them off the ground. The legs may either be held together or apart depending on the particular exercise being performed.

For young gymnasts or those new to the sport, performing pommel horse exercises is very difficult. Newcomers must spend a significant amount of time building the strength needed to perform these exercises. What is needed, therefore, is a training device that allows users to practice swinging their legs around in a circular motion, while at the same time developing the upper, mid, and lower body strength needed to perform pommel horse exercises. The benefits of such a device would not be limited to gymnasts or those desiring to perform pommel horse exercises. Such a device would also be beneficial to those simply desiring to build strength, muscle, stamina, coordination, flexibility or any combination thereof. Beyond its benefits in terms of general fitness, it may also have medical uses. For example, it may be used as part of a rehabilitation therapy or physical therapy for those having lower body or spinal injuries.

SUMMARY

An object of the present invention, therefore, is to provide a training device that allows users to place their hands on the floor and swing their legs in an arc-like motion.

Another object of the present invention is to provide a training device that allows users to place their hands on the floor and swing their legs around in a circular motion.

A further object of the present invention is to provide a light-weight and portable training device.

Yet another object of the present invention is to provide a training device that allows users to build strength, muscle, stamina, coordination, flexibility or any combination thereof. It is to these and other problems that the present invention is addressed.

In one embodiment, the present invention includes a training device comprising a disk having a perimeter. A foot-interface is attached to the disk, and a rolling member is positioned around the perimeter of the disk. In preferred embodiments, the rolling member is substantially concentric to essentially concentric with the disk.

In another embodiment, the training device comprises a substantially rigid disk having a perimeter and defining an aperture sized to receive a pair of feet. The device includes a foot-interface having a first leg-support attached to the disk and a second leg-support configured to mate with the first leg-support. The mating of the first and second leg-supports defines a pair of channels configured to receive a pair of legs. Preferably, the channels are configured to align with at least a portion of the aperture in the disk. A wheel is operably positioned substantially concentric with the disk and around the perimeter of the disk.

In another embodiment, the training device comprises a substantially rigid disk having a perimeter. The disk defines an aperture sized to receive a pair of feet, wherein at least a portion of the aperture is positioned substantially axially within the disk. The device also includes a foot-interface having a first leg-support attached to the disk and a second leg-support configured to mate with the first leg-support and thereby define a pair of channels configured to receive a pair of legs. The pair of channels is configured to align with at least a portion of the aperture. A wheel is positioned substantially concentric with the disk around the perimeter of the disk. The device also includes a bearing. The bearing has an annular front-mount configured to connect to the disk, an annular rear-mount configured to connect to the wheel, and a plurality of ball bearings positioned between the front-mount and the rear-mount, thereby allowing the rotation of the wheel about the disk.

These and other aspects of the present invention will become apparent to those skilled in the art after a reading of the following description of the preferred embodiment when considered with the drawings. Further, the above summary was intended to summarize certain embodiments of the invention rather than provide an exhaustive disclosure. A more detailed disclosure is provided below.

DETAILED DESCRIPTION

Figure 1:
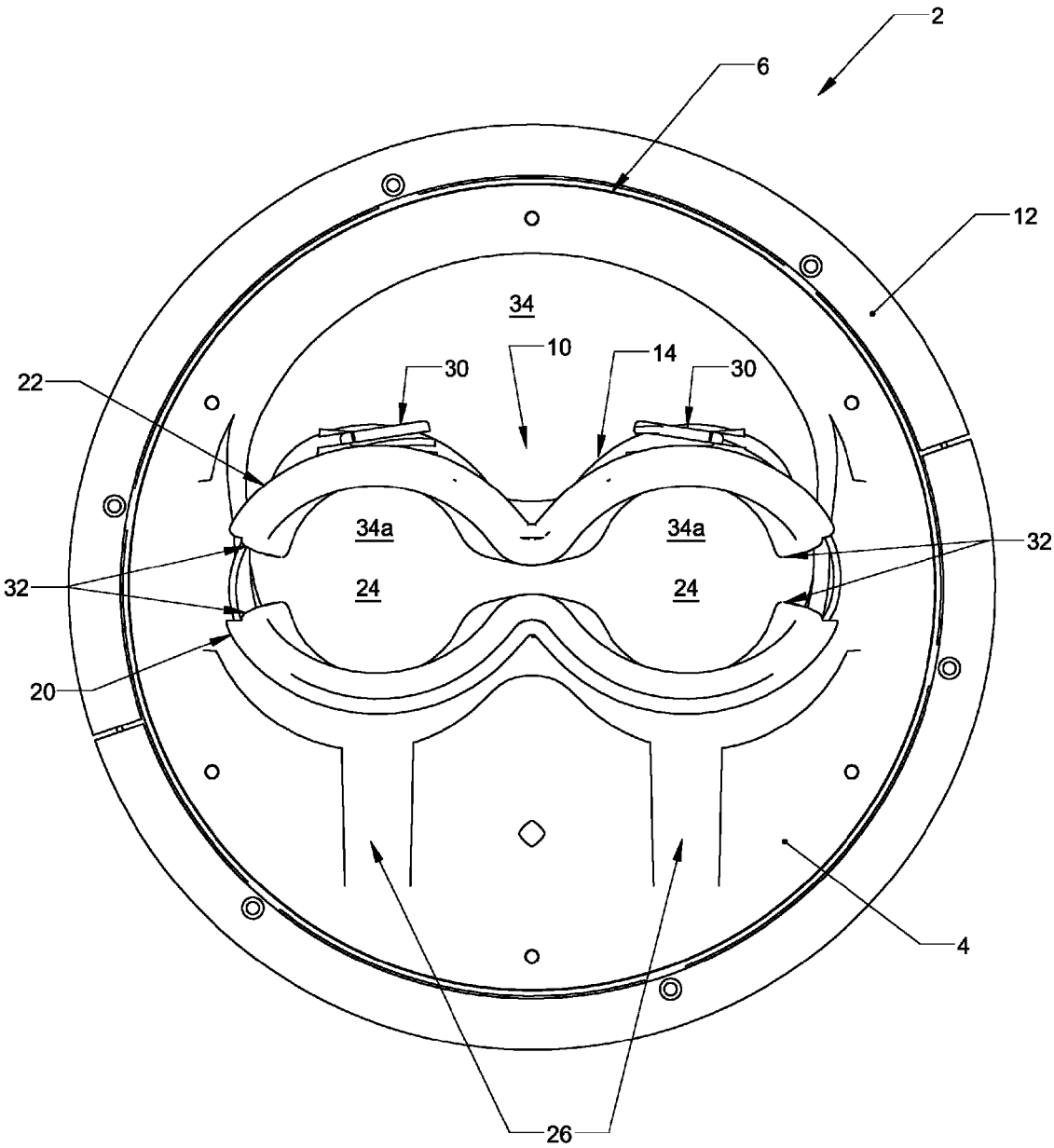
FIG. 1 shows a front view of one embodiment of the training device of the present invention.
Figure 2:
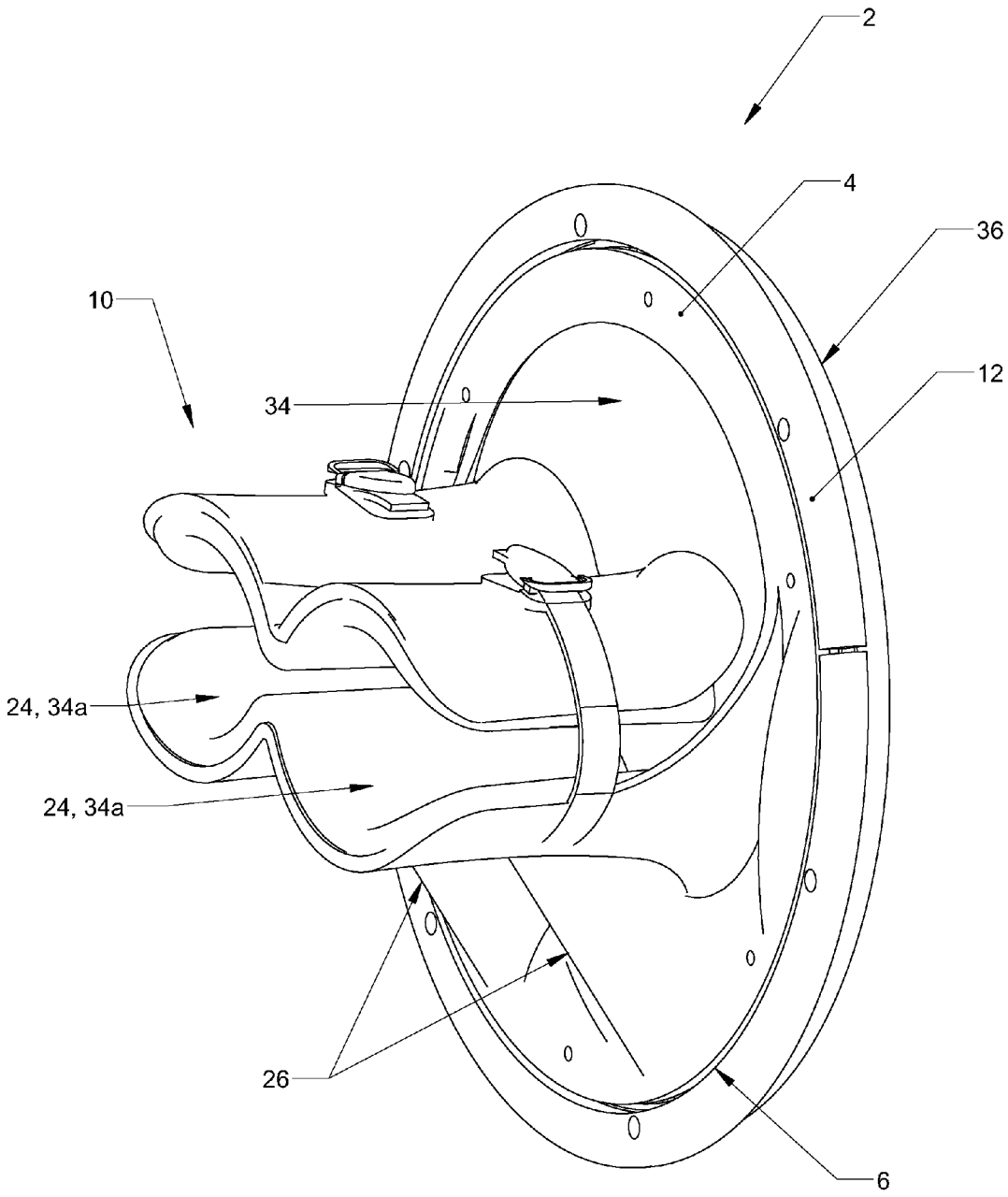
FIG. 2 shows a front perspective view of the embodiment shown in FIG. 1.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms. Further, it will be understood that the illustrations are for the purpose of describing a preferred embodiment of the invention and are not intended to limit the invention thereto.

FIGS. 1, 2, 3, 4, 5*a*, 5*b*, and 5*c* show various views of one embodiment of the training device 2 of the present invention. In this embodiment, device 2 includes disk 4 having perimeter 6. Foot-interface 10 is attached to disk 4, and rolling member 12 is positioned substantially concentrically around the perimeter of disk 4.

Disk 2 is essentially circular, as shown, to facilitate rotation, yet others may prefer a substantially circular or slightly non-circular to non-circular design, for example, to increase the resistance to rotation. Disk 2 is preferably made of a rigid material and even more preferably is rigid enough to support the weight of a user while substantially maintaining its disk-like shape or ability to roll. Such shapes and rigidities may be achieved by a variety of materials, however, applicant prefers plastic.

Figure 5A:
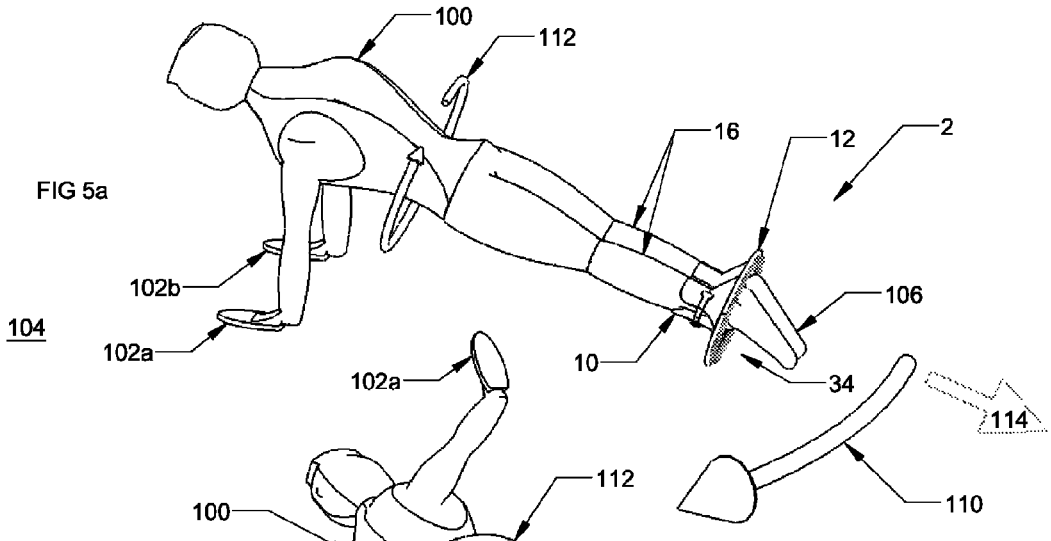
FIGS. 5*a*, 5*b*, and 5*c* show perspective views of the device of FIG. 1 in use.
Figure 5B:
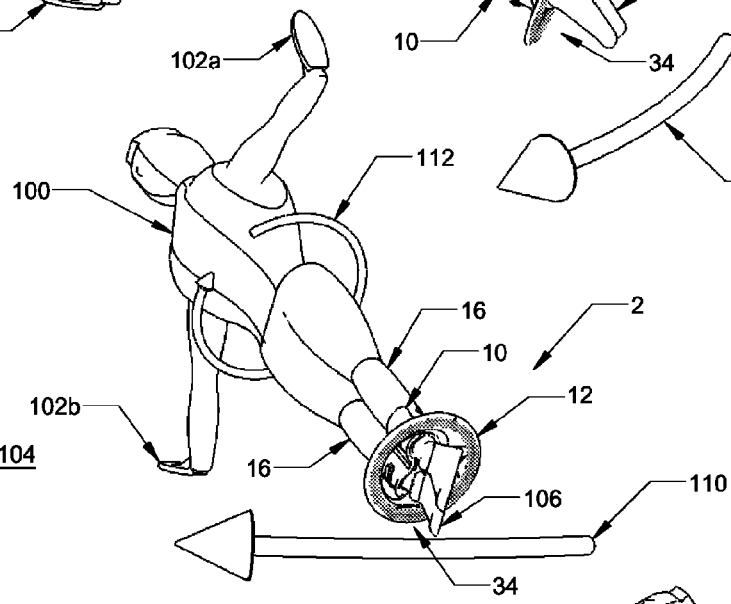
Figure 5C:
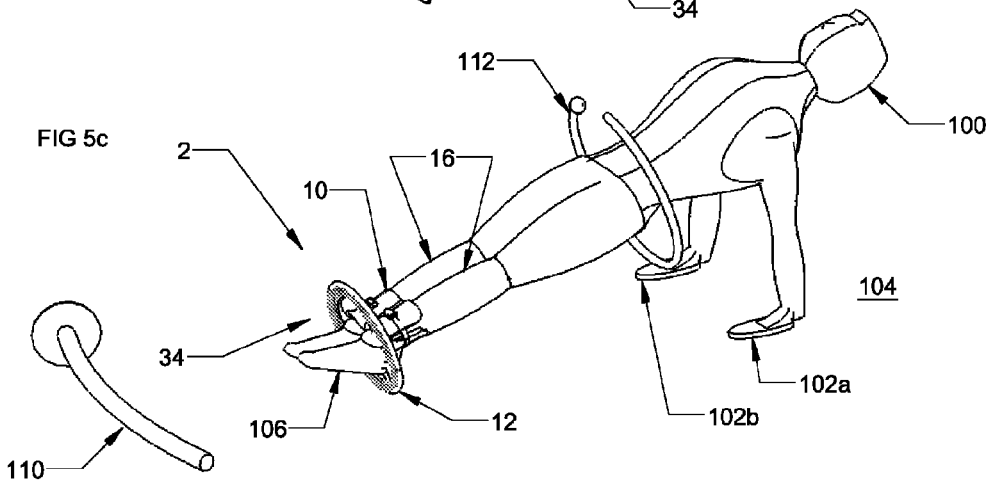

Foot-interface 10 includes clamp 14 configured to releasably connect to at least one of a person's legs 16. Clamps of the present invention may be constructed in a variety of ways, e.g., hinged or non-hinged, and configured to attach to various parts of a person's leg or legs, such as, for example, the upper leg, the lower leg, the ankle, the calf, the shin, or the foot, or any combination. While applicant prefers to attach about the ankle, calf or shin, as shown in FIGS. 5*a*, 5*b*, and 5*c*, others may prefer to attach at other locations depending on the type of training or physical therapy desired or prescribed. For example, clamping about the upper thigh may be preferred for people or patients with limited lower leg movement or control.

The preferred clamp 14 of the present invention includes a first leg-support 20 extending from disk 4 and a second leg-support 22 configured to mate with the first leg-support and thereby define at least one channel 24. Channel 24 is preferably sized for receiving the desired portion of the person's leg, legs, ankle, ankles, foot, or feet. In certain embodiments, the preferred clamp of the present invention will define two channels 24, as illustrated, but in other embodiments, such as single leg embodiments discussed later, only a single channel 24 would be needed. Channel 24 is preferably positioned substantially axially with respect to disk 4.

Those of ordinary skill in the art will recognize that first leg-support 20 can connect to disk 4 in a variety of ways, all of which are considered to be within the scope of the present invention. Applicant prefers to connect first leg-support 20 to disk 4 through integral molding. Applicant also prefers to connect at least one truss 26 to disk 4 that is configured to support first leg-support 20. Truss 26 can be a separate structure or may be molded from the same material as the disk and first leg-support. A preferred design of the present invention includes molding disk 4, first leg-support 20, and truss 26 as an integral unit. Applicant believes such an integral construction allows for a product with an improved strength to weight ratio because the truss will allow for a thinner or lighter construction material, and because the truss creates negative space 26*a* in the disk (shown in FIG. 3).

Device 2 preferably includes fastener 30. In this embodiment, fastener 30 is a belt and buckle type of fastener configured to adjustably mate first leg-support 20 with second leg-support 22. Those of ordinary skill in the art will recognize that a variety of fasteners may be used to achieve the present invention, for example the fastener may be a clip, laces, hook and loop (e.g., VELCRO), screw based, etc.

Clamp 14 may also include an insert 32, such as a foam insert, positioned to cushion the clamp force of the clamp.

In preferred embodiments of the present invention, disk 4 defines aperture 34. Aperture 34 is preferably sized to receive at least one foot. In the embodiment shown in FIG. 5*a*, aperture 34 is sized to receive two feet. At least a portion of aperture 34, such as portion 34*a*, is substantially axial with respect to disk 4 and channel 24. This positioning allows at least one foot to extend substantially axially through disk 4 as shown in FIG. 5*a*. Some may prefer to practice the present invention without an aperture, which would be considered to be encompassed by the present invention.

Figure 3:
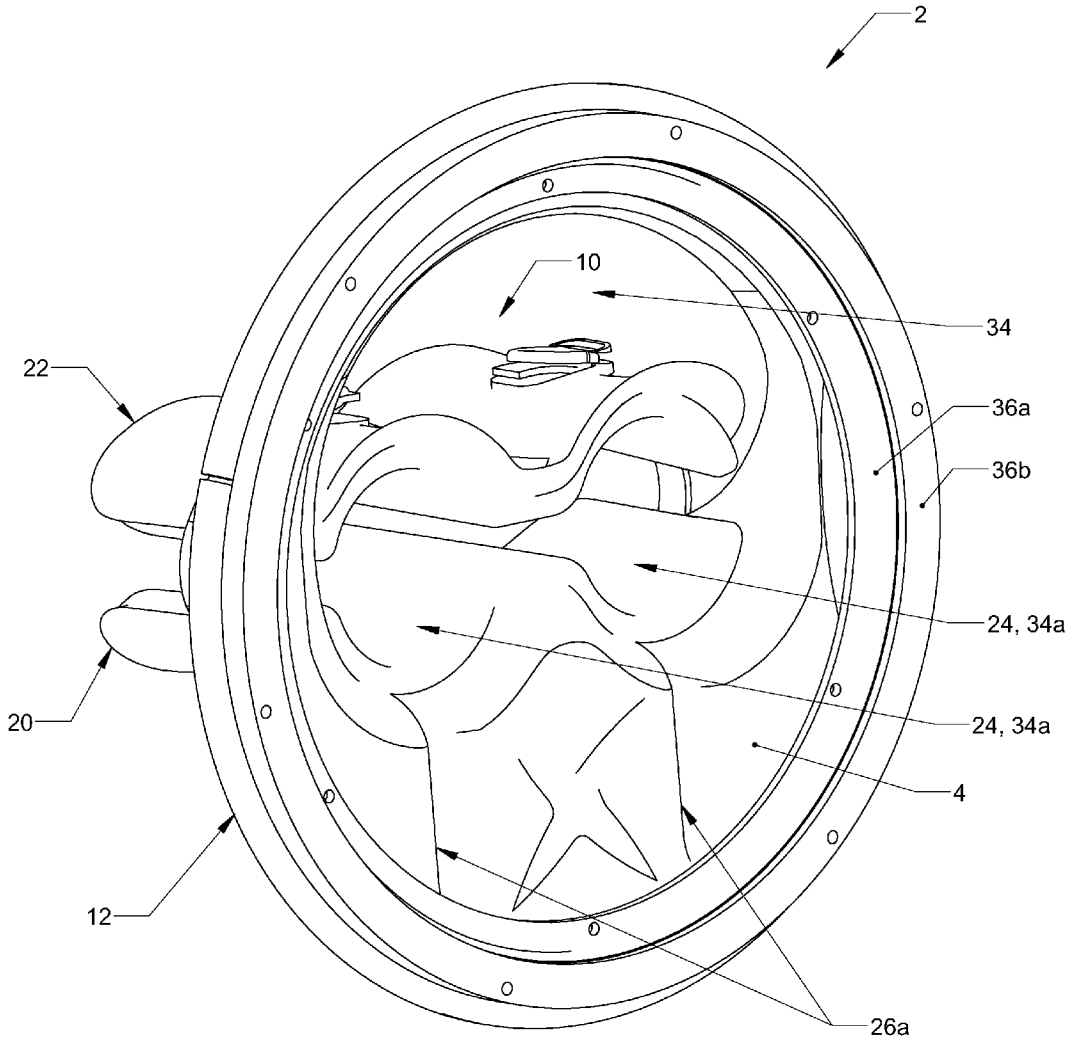
FIG. 3 shows a rear perspective view of the embodiment shown in FIG. 1.
Figure 4:
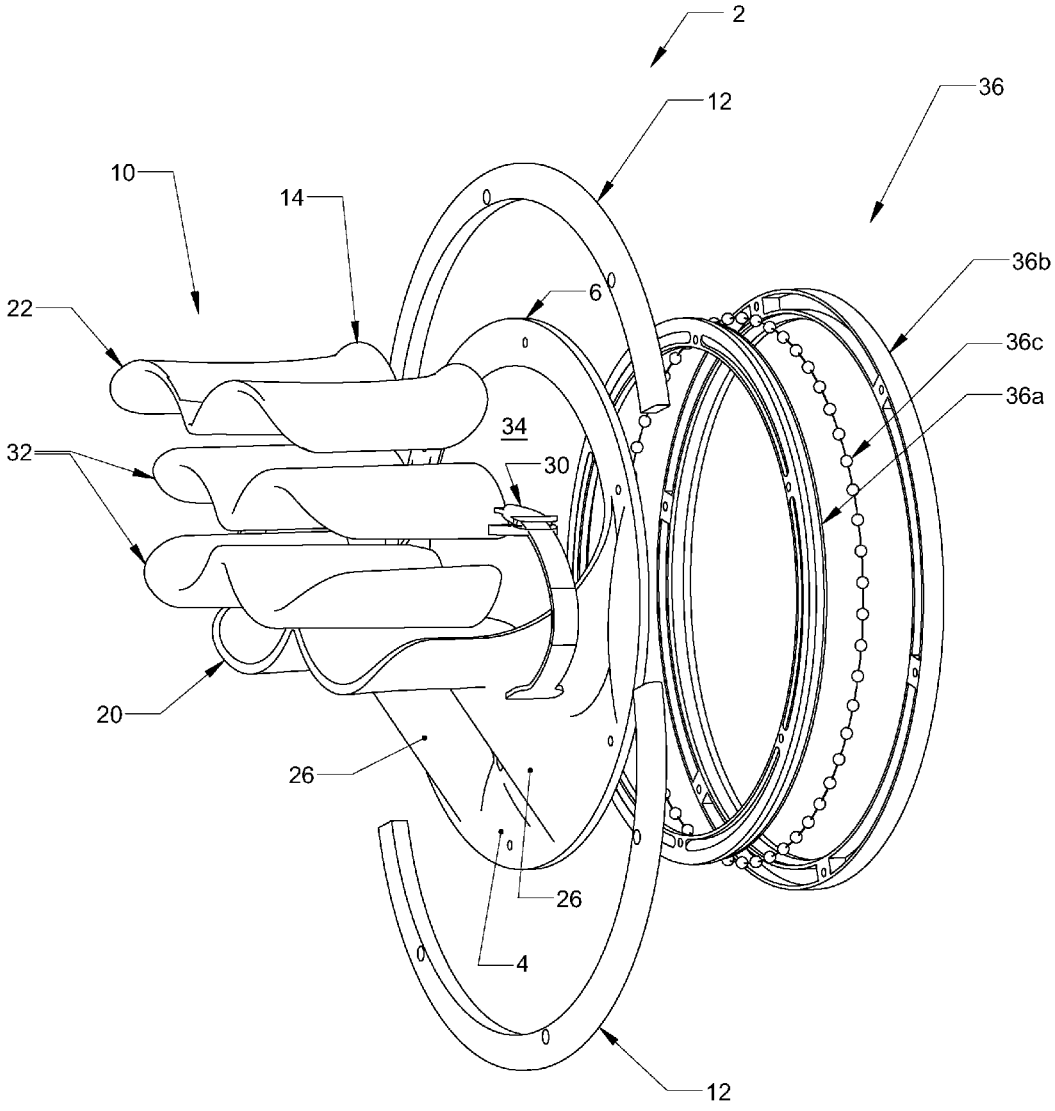
FIG. 4 shows an exploded front perspective view of the embodiment shown in FIG. 1.

In the present embodiment, the rolling member 12 is a wheel. Wheel 12 is positioned around perimeter 6 of disk 4 and is configured to rotate around disk 4. Preferably, rolling member 12 is substantially concentric with disk 4. In this embodiment, device 2 also includes bearing 36 operably connected between disk 4 and wheel 12 in such a manner to allow wheel 12 to rotate relative to disk 4 or vice versa. As best seen in FIGS. 3 and 4, bearing 36 is substantially annularly shaped, and is positioned substantially concentrically with disk 4.

In the exploded view of device 2, shown in FIG. 4, bearing 36 includes front-mount 36*a*, rear-mount 36*b*, and at least one ball bearing 36*c*, and more preferably, as shown, a plurality of ball bearings. Front-mount 36*a* is configured to connect to disk 4. Rear-mount 36*b* is configured to connect to wheel 12. Front-mount 36*a* and rear-mount 36*b* are mate-able and define a channel for ball bearing 36*c*. By connecting front-mount 36*a* to disk 4, and rear-mount 36*b* to wheel 12, wheel 12 can rotate around disk 4. Some may wish to use different bearings or to configure wheels and disks in other ways. For example, some may prefer to position the wheel in a channel defined by the disk and allow the wheel to rotate along a sleeve without the use of a bearing, or to use any number of impregnated plastic or self lubricating plastic materials that can be used as bearings. All such variations are considered to be within the scope of the present invention.

FIGS. 5*a*, 5*b*, and 5*c* show one embodiment of the training device 2 in use by person 100. Legs 16 attach to the foot-interface 10 of device 2, and feet 106 pass through aperture 34. Preferably, the configuration of the device, such as device 2, allows the feet to point substantially away from the body, as shown, which is preferably for facilitating rotation and for developing the proper form for pommel horse exercises. FIG. 5*a* shows person 100 in a chest-down position with hands 102*a* and 102*b* placed on ground 104. By moving legs 16 in the direction of arrow 110, wheel 12 rolls over floor 104 to accommodate the translational motion of person 100 and of device 2. At the same time, disk 4 rotates in the direction of arrow 112 to accommodate the rotational motion of person 100 generated by use of the device. FIG. 5*b* shows person 100 making the transition from the chest-down to the chest-up position as legs 16 are moved in an arc-like motion. Hand 102*a* is lifted while hand 102*b* remains at a substantially fixed point to allow for the revolution of the legs. The rotational movement of legs 16 within device 2 relative to their position in FIG. 5*a* is visible. FIG. 5*c* shows person 100 after they have completed the transition to the chest-up position. Both hands 102*a* and 102*b* are back on ground 104. The rotational movement of legs 16 relative FIGS. 5*a* and 5*b* is also visible. While the use of device 2 above was described from a chest-down to a chest-up position, those of ordinary skill in the art will recognize that use of the device may begin from any position and end in any position.

In some embodiments, e.g., the wheeled embodiment described above, the force of friction created by contact between wheel 12 and floor 104 impedes device 2 from moving in the direction of arrow 114, which may be sometimes desirable. For example, young children or those beginning pommel horse training may lack the strength to prevent device 2 from moving in the direction of arrow 114, which would thus limit their ability to move in an arc-like motion. Even more experienced or stronger users may desire a restriction of movement in the direction of arrow 114 in order to concentrate on specific muscle groups or timing or coordination, or any combination thereof. In some embodiments, however, e.g., certain roller embodiments, movement in the direction of arrow 114 may be desired.

Figure 6:
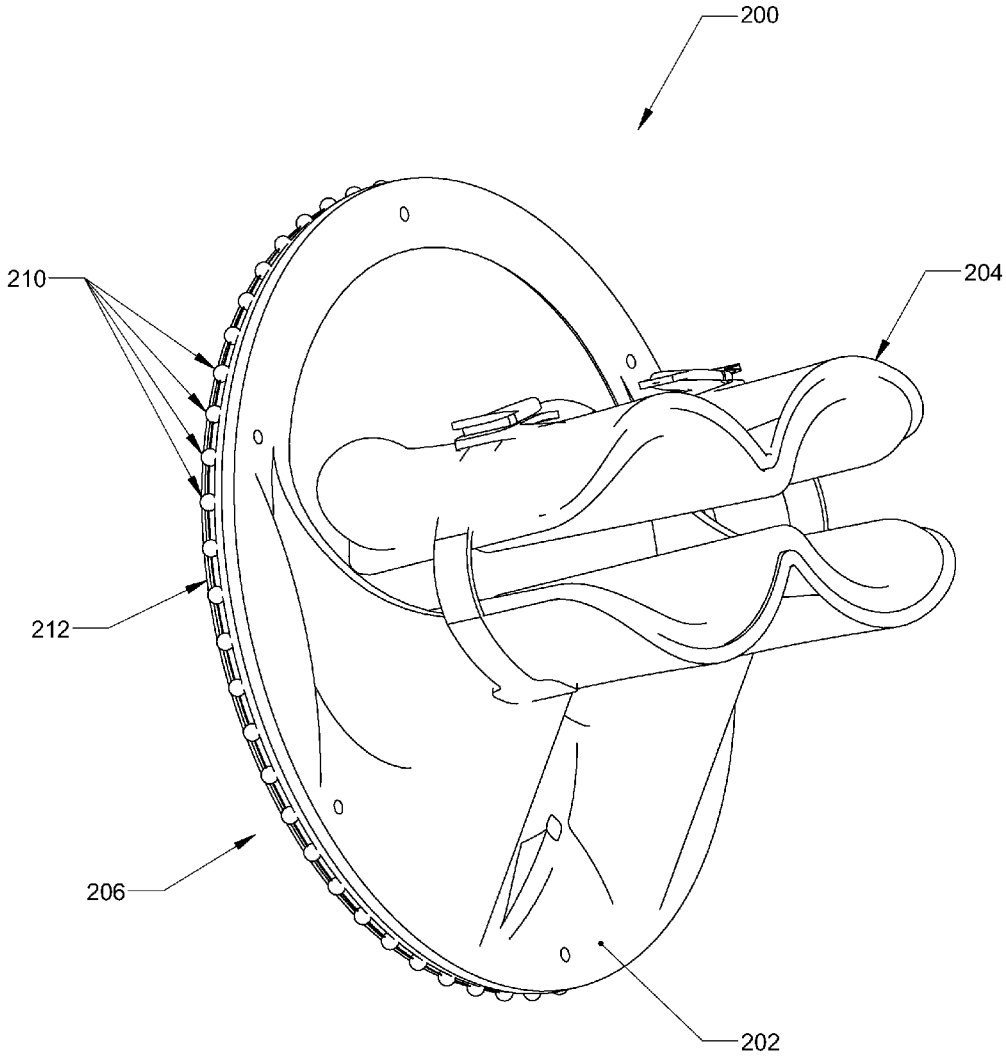
FIG. 6 shows another embodiment of the present invention.

FIG. 6 shows another embodiment of the training device 200 of the present invention. In this embodiment, the device 200 is somewhat similar to the embodiment previously described. For example, device 200 includes disk 202, foot-interface 204, and rolling member 206. In this embodiment, however, rolling member 206 includes a plurality of rollers 210 positioned as spaced locations around the perimeter of disk 202. Preferably, the rollers 210 are operably positioned in channel 212 defined near the perimeter of disk 202, yet others may position in other ways, e.g., without a channel. Rollers 210 may be free-rolling, such as a ball bearing able to roll in any direction, or may be individually axially mounted. Free-rolling embodiments may be desirable, as discussed above, for those who desire to have a device that is unrestricted in its movement in the direction of arrow 114.

Figure 7:
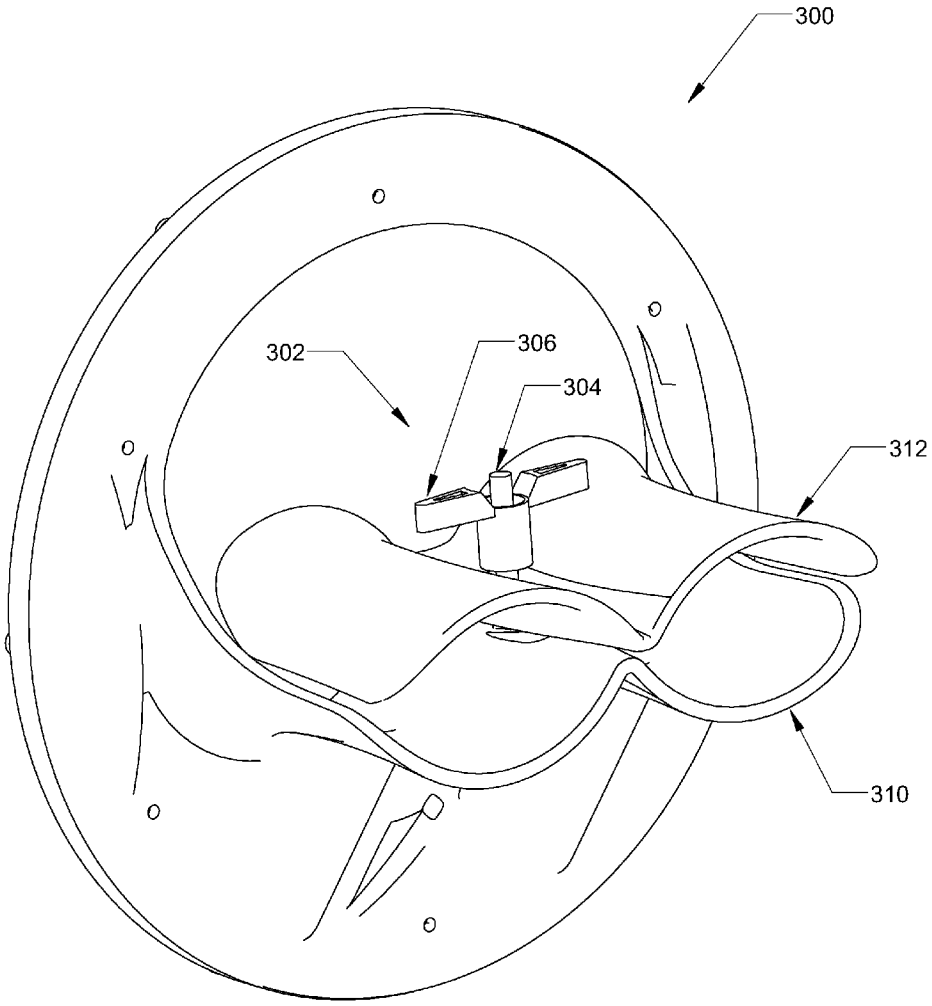
FIG. 7 shows another embodiment of the present invention.

FIG. 7 shows another embodiment 300 of the present invention having a different fastener 302. In this embodiment, fastener 302 includes a bolt 304 and a nut 306, which is preferably a wing-nut to allow for hand tightening. Bolt 304 extends through first leg-support 310 and through second leg-support 312. The tightening or loosening of nut 306 about bolt 304 allows device 300 to be releasably connected to at least one of a person's legs.

Figure 8:
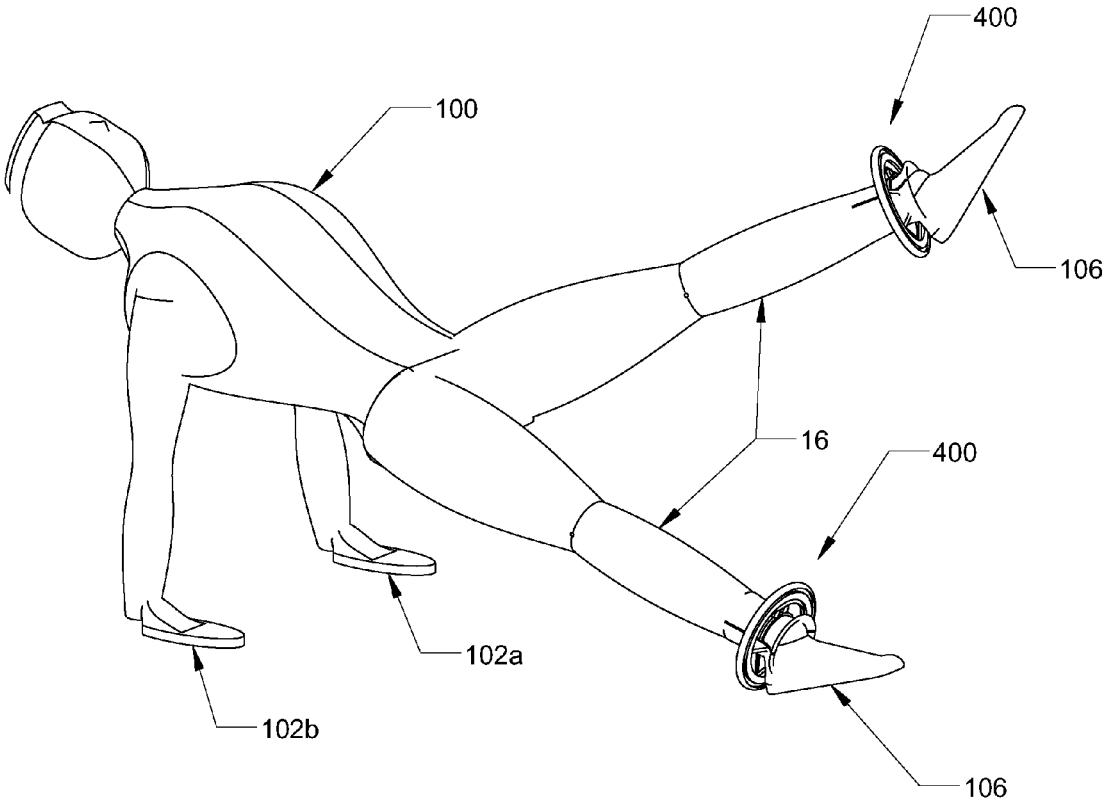
FIG. 8 shows another embodiment of the present invention
Figure 9:
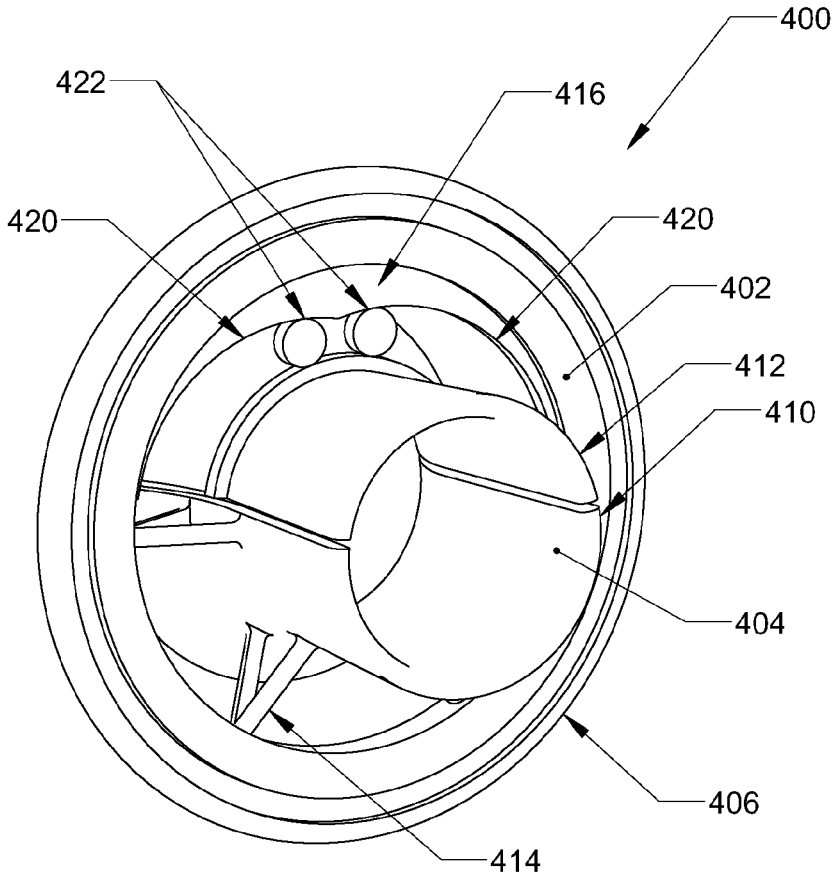
FIG. 9 shows a close-up view of the embodiment shown in FIG. 8.

FIG. 8 shows another embodiment of the present invention. In this embodiment, device 400 is configured to mount to a single leg rather than both of the user's legs. Such an embodiment may be ideal for one-legged users or may be ideal for those desiring a greater range of movement and muscle development in their training FIG. 9 shows a close-up view of the device shown in FIG. 8. Device 400 includes disk 402, foot interface 404, and rolling member 406. Foot-interface 404 includes first leg-support 410 and second leg-support 412. In this embodiment a series of trusses 414 support first leg-support 410. First-leg support 410 and second leg-support 412 clamp device 400 to a person's leg. In this embodiment, foot-interface 404 includes fastener 416. Fastener 416 includes a ramp 420 and a pair of disks 422. By moving disks 422 along ramp 420, foot-interface 404 can be tightened or loosened as desired.

Figure 10:
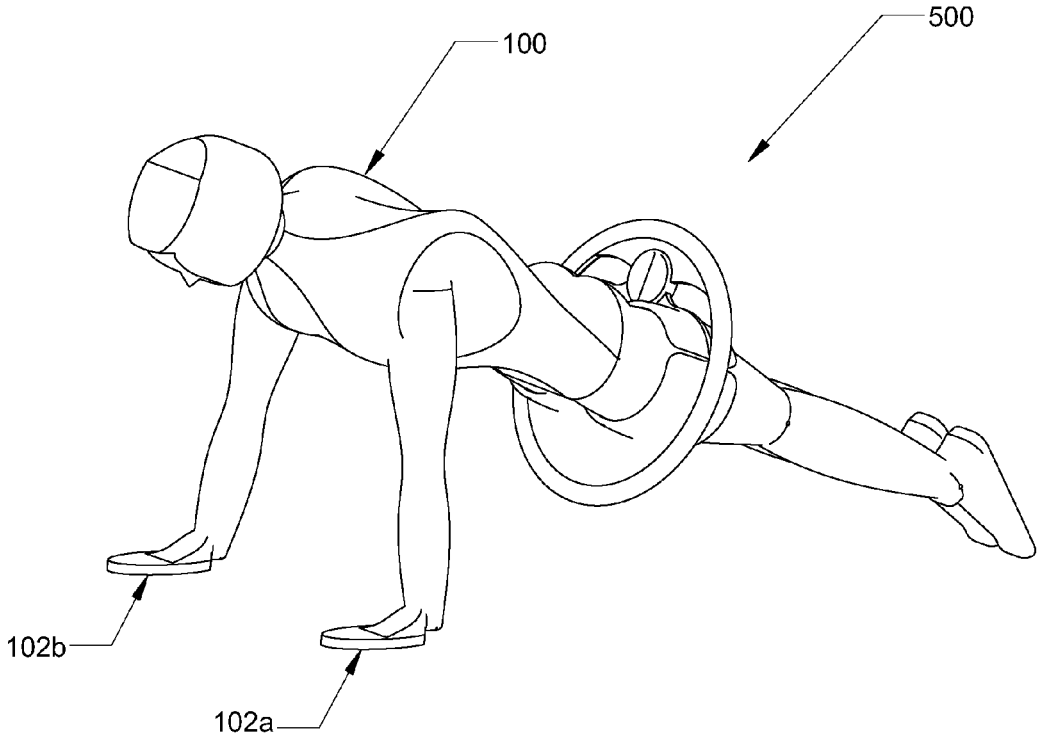
FIG. 10 shows another embodiment of the present invention.
Figure 11:
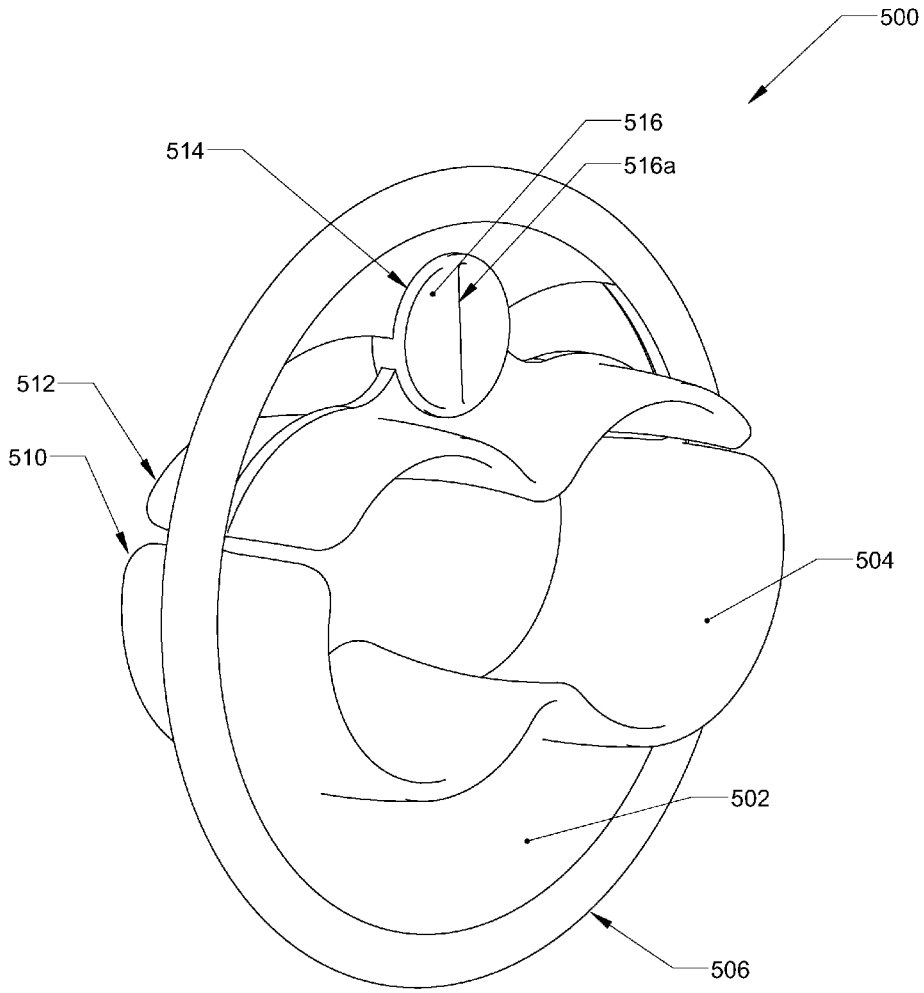
FIG. 11 shows a close-up view of the embodiment shown in FIG. 10.

FIG. 10 shows another embodiment of the present invention. In this embodiment, device 500 is shown mounted about the upper portion or thigh of a person's legs. FIG. 11 shows a close-up view of device 500. Device 500 includes disk 502, foot-interface 504, and rolling member 506. Foot-interface 504 includes a first leg-support 510 and second leg-support 512, which clamp to a person's leg or legs. In this embodiment, foot-interface 504 includes fastener 514. Fastener 514 includes cam 516 having handle 516*a*. By turning handle 516*a*, foot-interface 504 can be tightened or loosened as desired.

Figure 12A:
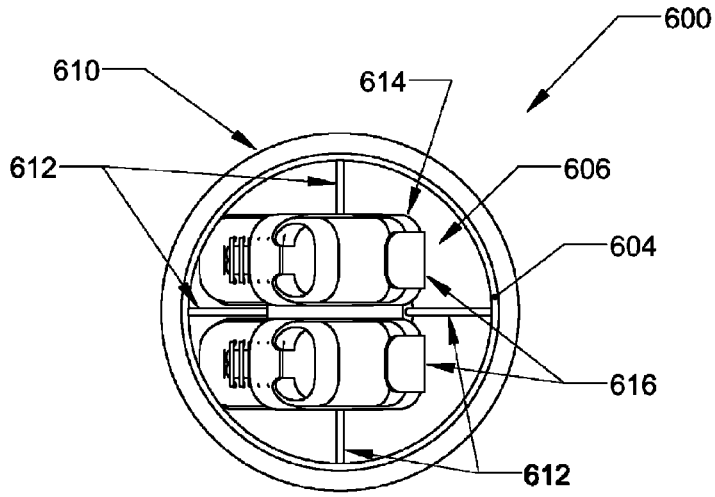
FIGS. 12*a*, 12*b*, and 12*c* show another embodiment of the present invention.
Figure 12B:
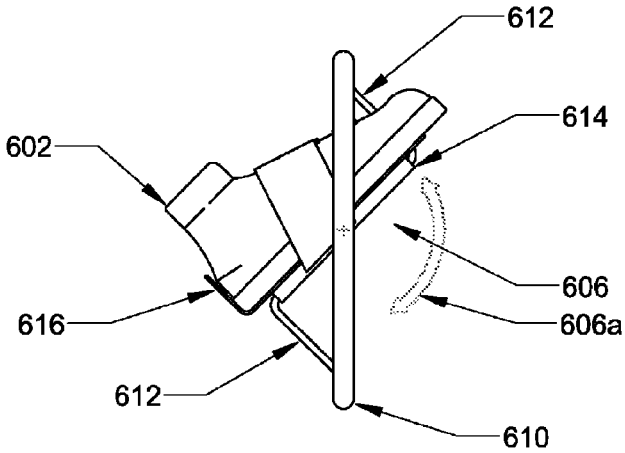
Figure 12C:
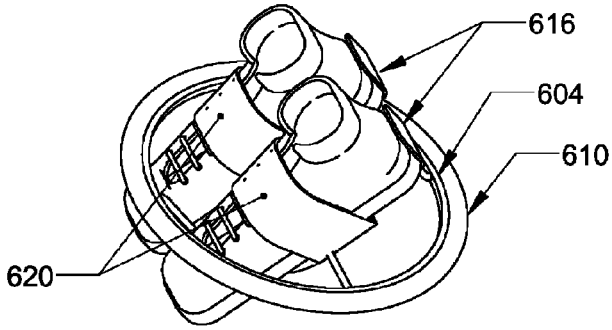

FIGS. 12*a*, 12*b*, and 12*c* show various views of another embodiment of the present invention. In this embodiment, device 600 is shown attached to a pair of shoes 602. Device 600 includes a disk 604, foot-interface 606, and rolling member 610. In this embodiment, disk 604 is substantially annularly shaped. Foot interface 606 attaches to disk 604 through mounts 612, and includes platform 614 on which shoes 602 rest. Preferably platform 614 is slanted relative to disk 604, and even more preferably is slanted to allow for the extension or pointing of the toes away from the body, as shown. Applicant prefers this type of construction, in this embodiment, because it allows for the toes to remain pointed substantially in-line with the shins as the body rotates. The slant of platform 614 may be adjusted as depicted by arrow 606*a* to the desired degree to account for the flexibility of individual users. The ability to point the toes while using various embodiments of the present invention may be desirable, however, for proper rotation. Platform 614 may be adjusted through the extension, contraction, or rotation of mounts 612. Flange 616 and arches 620 connect to platform 614 and help maintain the position of shoes 602.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed.

What is claimed is:

1. A training device comprising:

a disk having a perimeter;

a foot-interface attached to said disk, wherein said disk includes a substantially rigid surface between said foot-interface and said perimeter for preventing rotational movement of said foot-interface relative to said disk while the device is in use, and wherein said disk defines an aperture for a portion adjacent to said rigid surface, and wherein said foot-interface is configured to allow a portion of a user's leg to extend through said aperture; and a rolling member positioned around said perimeter of said disk, wherein said rolling member is configured to allow said disk to roll in at least 360 degree rotation on a floor.

2. The device of claim 1, wherein said foot-interface includes a rigid first leg-support extending axially away from said disk for a length thereby defining one part of a channel configured to releasably connect to at least one of a user's legs.

3. The device of claim 2, wherein said foot interface includes a separable second leg-support configured to mate with said first leg-support and thereby define at least one extended channel substantially axially positioned with respect to said disk.

4. The device of claim 3, further including a fastener configured to adjustably mate said first leg-support with said second leg-support.

5. The device of claim 3, further including at least one truss connected to said disk and extending distally from said disk to connect to said first leg-support and thereby support said leg-support when said device is in use and said leg-support is substantially horizontally oriented and bearing the weight of a user.

6. The device of claim 1, wherein said disk defines an aperture sized to receive at least one foot.

7. The device of claim 6, wherein said aperture includes a portion substantially axial with respect to said disk and to a channel created by said foot-interface for receiving at least one foot, thereby allowing said at least one foot to extend substantially axially through said disk.

8. The device of claim 1, wherein said rolling member includes a wheel positioned substantially concentrically with said disk, said wheel being configured to rotate around said disk.

9. The device of claim 8, further including a bearing operably connecting said wheel and said disk.

10. The device of claim 9, wherein said bearing includes a front-mount configured to connect to said disk, a rear-mount configured to connect to said wheel, and at least one ball bearing positioned between said front-mount and said rear-mount, thereby allowing the rotation of said wheel about said disk.

11. The device of claim 9, wherein said bearing is substantially annularly shaped.

12. The device of claim 11, wherein said bearing is positioned substantially concentrically with said disk.

13. The device of claim 1, wherein said rolling member includes a plurality of rollers positioned as spaced locations around the perimeter of said disk.

14. The device of claim 1, wherein said perimeter of said disk defines a channel and wherein said rolling member includes a plurality of rollers operably positioned within said channel.

15. The device of claim 1, wherein said rolling member is substantially concentric with said disk.

16. A training device comprising:

a substantially rigid disk having a perimeter and a substantially rigid surface defining an aperture for a portion adjacent to said rigid surface sized to receive a pair of feet;

a foot-interface having a first leg-support integral with said rigid surface of said disk and a separable second leg-support configured to releasably mate with said first leg-support and define a pair of channels extending axially away from said disk and configured to receive a pair of legs, said channels being configured to align with at least a portion of said aperture, wherein said foot-interface does not rotate relative to said rigid disk while the device is in use; and a wheel operably positioned substantially concentrically with said disk and around said perimeter of said disk and configured to allow said disk to roll in at least 360 degree rotation on a floor.

17. The device of claim 16, further including a fastener configured to adjustably mate said first leg-support with said second leg-support.

18. The device of claim 16, including a bearing including a front-mount configured to connect to said disk, a rear-mount configured to connect to said wheel, and at least one ball bearing positioned between said front-mount and said rear-mount, thereby allowing the rotation of said wheel about said disk.

19. A training device comprising:

a substantially rigid disk having a perimeter and defining an aperture sized to receive a pair of feet, wherein at least a portion of said aperture is positioned substantially axially within said disk;

a foot-interface having a first leg-support defined by said rigid portion of said disk and a second leg-support configured to adjustably mate with said first leg-support thereby defining a pair of channels extending axially away from said disk and configured to receive a pair of legs, said pair of channels being configured to align with at least a portion of said aperture, wherein said foot-interface does not rotate relative to said disk while the device is in use;

a wheel positioned substantially concentrically with said disk and around said perimeter of said disk and configured to allow said disk to roll in at least 360 degree rotation on a floor; and a bearing having an annular front-mount configured to connect to said disk, an annular rear-mount configured to connect to said wheel, and a plurality of ball bearings positioned between said front-mount and said rear-mount, thereby allowing the rotation of said wheel about said disk.

20. The device of claim 1, wherein said length of said foot interface is greater than the thickness of said disk.

* * * * *